US009193499B2

(12) United States Patent
Jordan

(10) Patent No.: US 9,193,499 B2
(45) Date of Patent: Nov. 24, 2015

(54) PAPERBOARD PALLET

(71) Applicant: LIBERTY DIVERSIFIED INTERNATIONAL, INC., New Hope, MN (US)

(72) Inventor: Kevin Jordan, Ramsey, MN (US)

(73) Assignee: Libery Diversified International, Inc., New Hope, MN (US)

( * ) Notice: Subject to any disclaimer, the term of this patent is extended or adjusted under 35 U.S.C. 154(b) by 0 days.

(21) Appl. No.: 14/203,042

(22) Filed: Mar. 10, 2014

(65) Prior Publication Data

US 2014/0251188 A1 Sep. 11, 2014

Related U.S. Application Data

(60) Provisional application No. 61/776,553, filed on Mar. 11, 2013, provisional application No. 61/776,588, filed on Mar. 11, 2013.

(51) Int. Cl.
*B65D 19/00* (2006.01)
*B65D 19/38* (2006.01)

(52) U.S. Cl.
CPC ..... *B65D 19/0012* (2013.01); *B65D 19/0081* (2013.01); *B65D 19/0095* (2013.01); *B65D 19/38* (2013.01); *B65D 2519/00019* (2013.01); *B65D 2519/00054* (2013.01); *B65D 2519/00089* (2013.01); *B65D 2519/00273* (2013.01); *B65D 2519/00288* (2013.01); *B65D 2519/00293* (2013.01); *B65D 2519/00308* (2013.01); *B65D 2519/00318* (2013.01); *B65D 2519/00323* (2013.01); *B65D 2519/00333* (2013.01); *B65D 2519/00343* (2013.01); *B65D 2519/00373* (2013.01); *B65D 2519/00378* (2013.01); *B65D 2519/00562* (2013.01)

(58) Field of Classification Search
CPC ..... B65D 2519/00019; B65D 2519/00054; B65D 2519/00089; B65D 2519/00124; B65D 2519/00159; B65D 2519/00303; B65D 2519/00228
USPC ..... 108/51.3, 51.11, 56.1, 56.3
See application file for complete search history.

(56) References Cited

U.S. PATENT DOCUMENTS

| | | | | | |
|---|---|---|---|---|---|
| 2,432,295 | A | * | 12/1947 | Donahue | 108/51.3 |
| 2,997,266 | A | * | 8/1961 | Munroe | 108/51.3 |
| 3,000,603 | A | * | 9/1961 | Hemann | 108/51.3 |
| 3,464,371 | A | * | 9/1969 | Gifford | 108/51.3 |
| 3,878,796 | A | * | 4/1975 | Morrison | 108/56.1 |
| 3,952,672 | A | * | 4/1976 | Gordon et al. | 108/51.3 |
| 4,220,099 | A | * | 9/1980 | Marchesano | 108/57.19 |

(Continued)

OTHER PUBLICATIONS

USPTO, Non-Final Office Action; Mar. 6, 2015.

*Primary Examiner* — Jose V Chen
(74) *Attorney, Agent, or Firm* — Barnes & Thornburg LLP

(57) ABSTRACT

A paperboard pallet is provided that includes first and second cardboard stringers positioned substantially parallel to each other. A space is formed between the first and second stringers. At least a first deck board is attached to and positioned substantially perpendicular to the first and second stringers. Both the first and second stringers include a notch on their top sides. Each notch on the top side of the first and second stringer is sized to receive the first deck board, and is located so a first side of the first deck board in each notch in the top side of the first and second stringers is located substantially flush with the first end of the first and second stringers.

7 Claims, 13 Drawing Sheets

(56) References Cited

U.S. PATENT DOCUMENTS

| | | | | | |
|---|---|---|---|---|---|
| 4,864,940 | A | * | 9/1989 | Dunn | 108/51.3 |
| 4,875,419 | A | * | 10/1989 | Helton et al. | 108/56.1 |
| 5,176,090 | A | * | 1/1993 | Roberts et al. | 108/51.3 |
| 5,184,558 | A | * | 2/1993 | Wozniacki | 108/51.3 |
| 5,195,440 | A | * | 3/1993 | Gottlieb | 108/51.3 |
| 5,230,291 | A | * | 7/1993 | Juvik-Woods | 108/51.3 |
| 5,333,555 | A | * | 8/1994 | McPhee | 108/57.19 |
| 5,377,600 | A | * | 1/1995 | Speese et al. | 108/51.3 |
| 5,433,156 | A | * | 7/1995 | Hutchison | 108/51.3 |
| 5,440,998 | A | * | 8/1995 | Morgan et al. | 108/57.18 |
| 5,487,345 | A | * | 1/1996 | Winebarger et al. | 108/51.3 |
| 5,537,935 | A | * | 7/1996 | Otaguchi et al. | 108/51.3 |
| 5,562,048 | A | | 10/1996 | Gottlieb | |
| 5,579,701 | A | * | 12/1996 | Fook Wah | 108/56.1 |
| 5,592,885 | A | | 1/1997 | Young et al. | |
| 5,685,234 | A | * | 11/1997 | Grigsby et al. | 108/51.3 |
| 5,909,712 | A | | 6/1999 | Tan | |
| 5,921,187 | A | * | 7/1999 | Wang | 108/51.3 |
| 5,996,509 | A | * | 12/1999 | Lai | 108/51.3 |
| 6,837,170 | B2 | * | 1/2005 | Taft | 108/57.25 |
| 8,286,563 | B2 | * | 10/2012 | Low | 108/56.3 |
| D679,065 | S | * | 3/2013 | Hershey et al. | D34/38 |
| 2006/0065170 | A1 | * | 3/2006 | Chen | 108/51.3 |

* cited by examiner

PAPERBOARD PALLET

RELATED APPLICATIONS

The present application is related to and claims priority to U.S. Provisional Patent Application Ser. No. 61/776,553, filed on Mar. 11, 2013, entitled "Paperboard Pallet" and U.S. Provisional Patent Application Ser. No. 61/776,588 filed on Mar. 11, 2013, entitled "Machine and Method for Making a Corrugated Paperboard Pallet." The subject matter disclosed in those provisional applications is hereby expressly incorporated into the present application.

TECHNICAL FIELD

The present disclosure relates to corrugated paper, cardboard, and/or fiber board pallets, as well as a method for making the same.

BACKGROUND AND SUMMARY

Conventional pallets are typically made of wood or plastic. Wood pallets consist of a plurality of spaced apart wood boards or stringers that are sandwiched between a plurality of spaced apart deck boards. These deck boards generally run parallel to each other and perpendicular to the stringers. When all the deck boards and stringers are nailed together, a secure platform is created that accommodates cargo, product, and other materials. In such wood pallet designs, spaces exist between the upper and lower deck boards that sandwich the stringers. These spaces are sized to accommodate forklift blades so that the products or materials setting on the pallet can all be lifted at one time when the forklift lifts the pallet.

The present disclosure is directed to a pallet made of cardboard or paperboard. Illustratively, the pallet may be made of corrugated cardboard. In one embodiment, a pallet may be made of cardboard stringers and deck boards. The stringers may be made of a composite of corrugated cardboard strips laminated together with glue to create a lightweight rigid structure. Similarly, the deck boards may be made from laminated strips of cardboard. The paperboard pallet provides a lightweight, high strength, solution for packing and/or warehousing product where a strong pallet is necessary but wood cannot be used because of issues such as insects in the pallet wood. For example, the food industry requires much of its packaged food product be stored and shipped on pallets, but insects in wood pallets pose a contamination risk. A paperboard pallet solution serves the pallet need, but does not have the issue with insects that a natural wood has.

Another illustrative embodiment of the present disclosure provides a paperboard pallet. The paperboard pallet comprises first and second stringers positioned substantially parallel to each other. Each of the first and second stringers is made of a plurality of bonded sheets of cardboard. A space is formed between the first and second stringers. Each of the first and second stringers has a top side, an underside, and a first end, wherein the underside is located opposite the top side. At least a first deck board attached to and positioned substantially perpendicular to the first and second stringers. Both the first and second stringers include a notch on their top sides. Each notch on the top side of the first and second stringer is sized to receive the first deck board, and is located so a first side of the first deck board in each notch in the top side of the first and second stringers is located substantially flush with the first end of the first and second stringers. Both the first and second stringers include a notch on their undersides. Each notch on the underside of the first and second stringer is sized to receive a second deck board, and is located so a first side of the second deck board in each notch of the underside of the first and second stringers is located substantially flush with the first end of the first and second stringers.

In the above and additional embodiments, the paperboard pallet may further comprise: the cardboard being corrugated cardboard; a third stringer located in the space formed between the first and second stringers, which creates a second space in addition to the first space, wherein the space and the second space are each sized to receive forklift fork; both of the first and second stringers have a second end located opposite the first end; a second deck board, wherein the second deck board is positioned substantially parallel to and spaced apart from the first deck board; a second notch on the top side of each of the first and second stringers, wherein each second notch on the top side of the first and second stringers is sized to receive the second deck board; and the second deck board being fitted in the second notch on the top side of each of the first and second stringers, wherein the deck board is substantially flush with the topside of the first and second stringers.

Another illustrative embodiment of the present disclosure provides a paperboard pallet that includes first and second stringers positioned substantially parallel to each other; each of the first and second stringers being made of a plurality of bonded sheets of cardboard; a space being formed between the first and second stringers; each of the first and second stringers has a side, a top side, and an underside; and a cardboard sheet wrapped around the side, the top side, and the underside of each of the first and second stringers.

In the above and additional embodiments, the paperboard pallet may further comprise: openings formed in the cardboard sheet over the space and adjacent the first and second stringers; a third stringer located in the space formed between the first and second stringers, which creates a second space in addition to the first space, wherein the space and the second space are each sized to receive a forklift fork; the cardboard sheet is corrugated cardboard; the cardboard sheet has first and second ends, wherein the cardboard sheet wraps around the side, the top side, and the underside of each of the first and second stringers, and an underside of the third stringer; the first end of the cardboard sheet attaches to the first side of the third stringer, and the second end of the cardboard sheet attaches to the cardboard sheet; and the second end of the cardboard sheet attaches to the first end of the cardboard sheet.

Additional features and advantages of the paperboard pallet will become apparent to those skilled in the art upon consideration of the following detailed description of the illustrated embodiment exemplifying the best mode of carrying out the paperboard pallet as presently perceived.

BRIEF DESCRIPTION OF DRAWINGS

The present disclosure will be described hereafter with reference to the attached drawings which are given as non-limiting examples only, in which.

Figure 1:
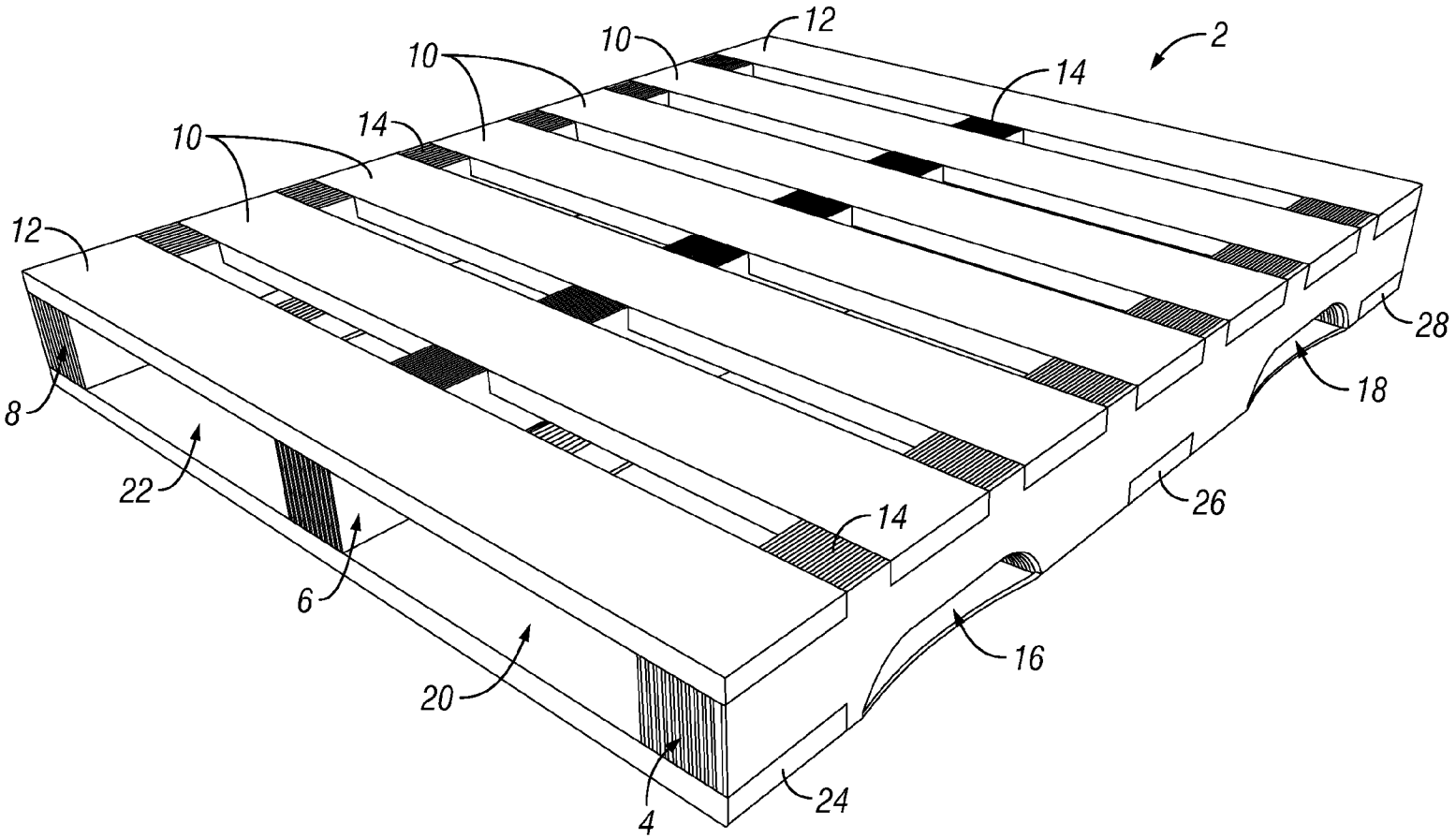
FIG. 1 is a perspective view of an illustrative embodiment of a paperboard pallet.

Corresponding reference characters indicate corresponding parts throughout the several views. The exemplification set out herein illustrates embodiments of the paperboard pallet and method of making, and such exemplification is not to be construed as limiting the scope of the paperboard pallet and method of making in any manner.

DETAILED DESCRIPTION OF THE DRAWINGS

A perspective view of an illustrative embodiment of a paperboard pallet 2 is shown in FIG. 1. Pallet 2 includes parallel-spaced and spaced apart stringers 4, 6, and 8 sized as desired in relation to a desired pallet size. Attached transversely to the top surface of stringers 4, 6, and 8 are deck boards 10 and leading-edge deck boards 12 on the top side 14 of stringers 4, 6, and 8. It is appreciated in this embodiment that deck boards 10 and 12 are essentially flush with the top side 14 of stringers 4, 6, and 8. As shown in this view, the stringers 4, 6, and 8 may each include a plurality of forklift slots 16 and 18 which are illustratively in communication with spaces 20 and 22 also located adjacent stringers 4, 6, and 8, respectively. It is appreciated that forklift slots 16 and 18 are configured to receive the blades (not shown) of a standard forklift. On the underside of stringers 4, 6, and 8 are underside deck boards 24, 26, and 28. It is appreciated that end deck boards 24 and 28 form a leading edge on the underside of pallet 2 just as top deck boards 12 form leading edges on the top side of pallet 2. It is also appreciated from this view how the deck boards and stringers are spaced apart in similar fashion to a conventional pallet to provide an air of familiarity, yet are not made of solid wood boards.

Figure 2:
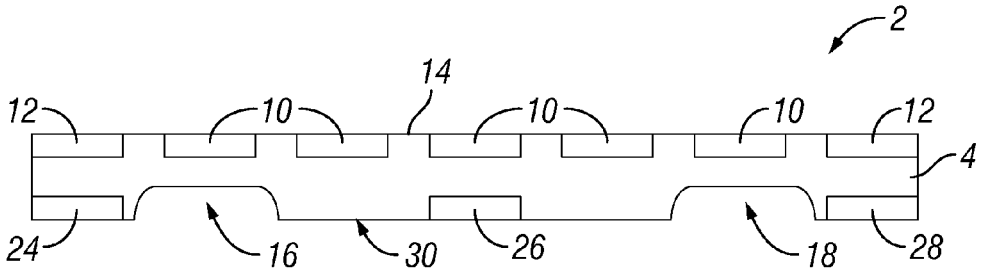
FIG. 2 is a side view of the paperboard pallet of FIG. 1.

A side view of pallet 2 is shown in FIG. 2. This view shows the shape of stringer 4 (like stringers 6 and 8) and how top deck boards 10 and 12, as well as underside deck boards 24, 26, and 28, have a top surface that is flush with top side 14 and bottom side 30 of stringer 4. Having deck boards in this configuration helps resist compression or crushing forces on the stringers when a load is applied to the deck boards. This view also includes stringer forklift cutouts 16 and 18. In an illustrative embodiment, the cutouts have a curved radius such as a 3 inch radius. This may help distribute the forces when a forklift blade lifts on the pallet, thereby moving the weaker point to a stronger part of the stringer. It is further appreciated that the laminations of corrugated cardboard may be 500# double wall corrugated board. In addition, the number of stringers on the top and the bottom may be more or less than what is shown herein, depending on the needs for the pallet.

Figure 3:
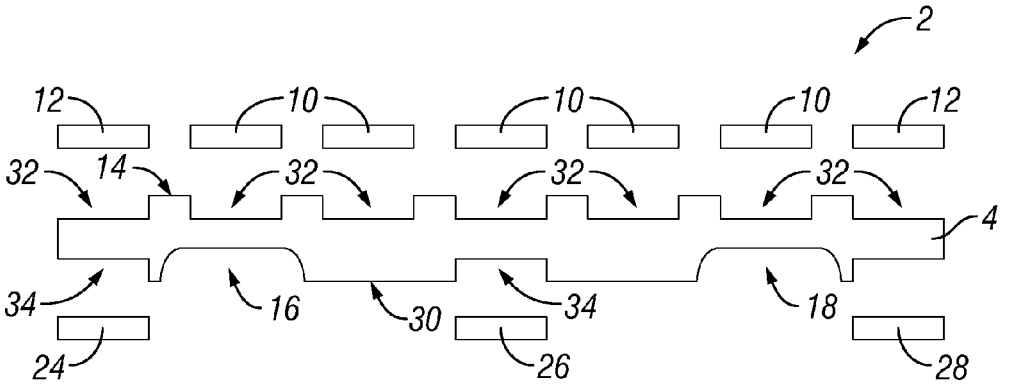
FIG. 3 is a side exploded view of the paperboard pallet of FIG. 1.

A side exploded view of pallet 2 is shown in FIG. 3. This view demonstrates how notches 32 and 34 are cut into the top and bottom of the stringers, such as stringer 4 shown, so the deck boards maintain a flush appearance with the top side 14 and underside 30 of pallet 2. It is also appreciated that the dimensions of the stringers and deck boards may be varied, depending on the needed size of the pallet.

Figure 4:
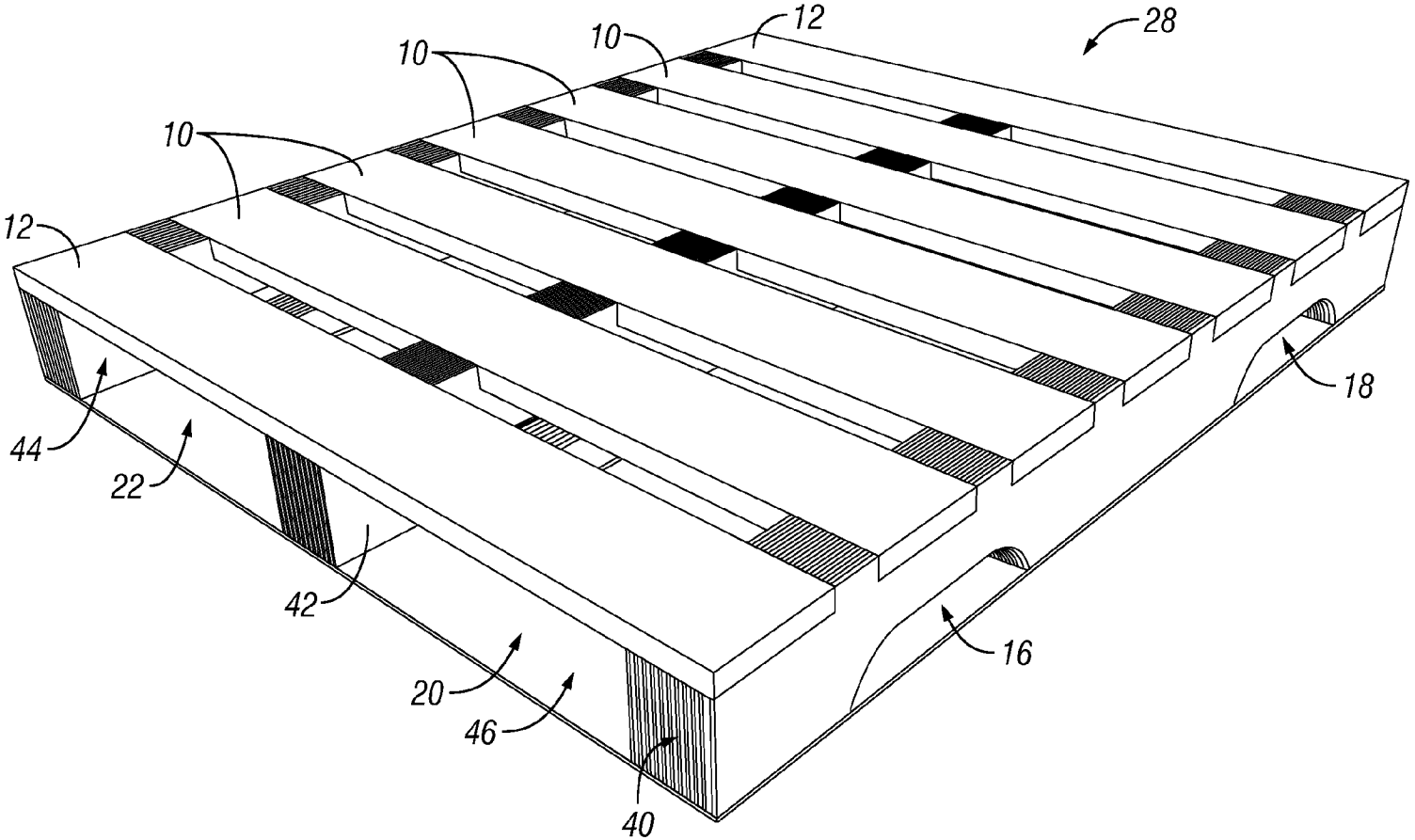
FIG. 4 is a perspective view of another illustrative embodiment of a paperboard pallet.

A perspective of another illustrative embodiment of a paperboard pallet 28 is shown in FIG. 4. It is appreciated that the use and configurations of the deck boards and stringers can be modified. Here, stringers 40, 42, and 44 include flush mounted deck boards 10 and 12 and include forklift slots 16 and 18 in communication with spaces 20 and 22. This embodiment also has a bottom sheet 46 that spans stringers 40, 42, and 44 on the underside of paperboard pallet 28. Bottom sheet 46 may help in resisting the bottom the stringers 40, 42, and 44, from separating during racking. Also, because as shown, bottom sheet 46 extends to the forklift holes 16 and 18, the sheet may also make these holes stronger. It is also appreciated that the forklift holes may be included on all sides of the pallet, including stringer 42. Spaces 20 and 22 may also have open ends so that a forklift may lift the pallet from any direction with respect to the pallet.

Figure 5:
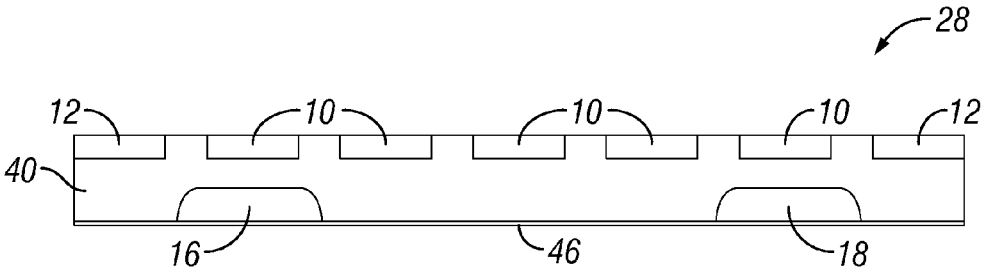
FIG. 5 is a side view of the paperboard pallet of FIG. 4.

A side view of pallet 28 is shown in FIG. 5. This view shows how top deck boards 10 and 12 are substantially flush with the top surface of the stringers 40, 42, and 44. Also shown is corrugated bottom sheet 46 attached to the underside of stringers 40, 42, and 44. This view also shows forklift openings 16 and 18.

Figure 6:
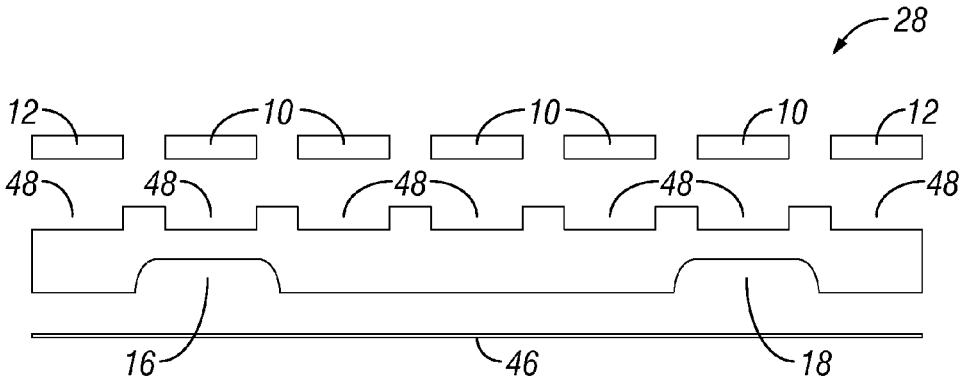
FIG. 6 is a side exploded view of the paperboard pallet of FIG. 4.

A side exploded view of pallet 28 is shown in FIG. 6. This view demonstrates the versatility in using deck boards and sheets. Similar to the prior embodiment, notches 48 may be cut into the stringer to create space for deck boards 10 and 12 to fit in the flush configuration. Bottom sheet 46 is attached to the underside of the stringers.

Figure 7:
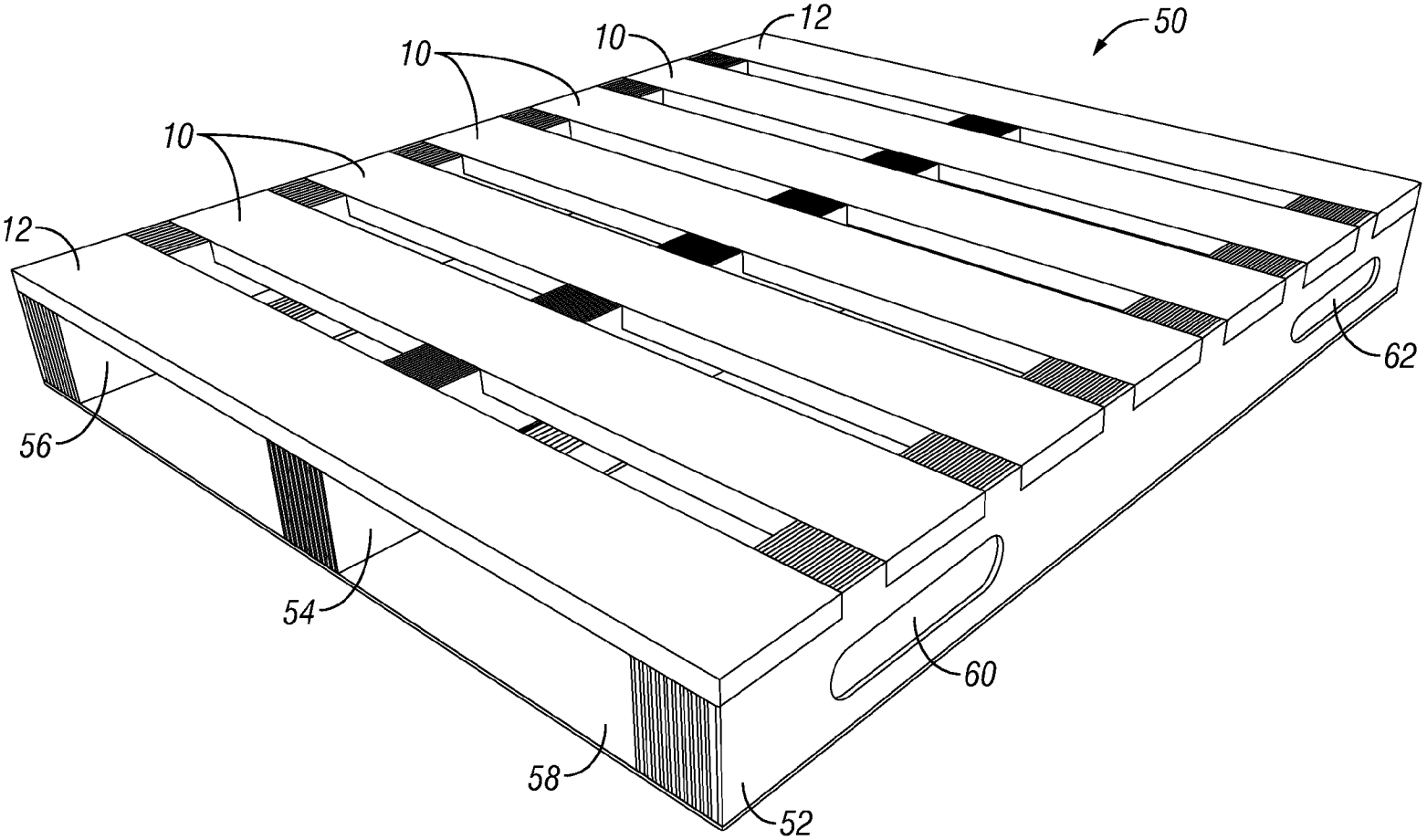
FIG. 7 is a perspective view of another illustrative embodiment of a paperboard pallet.

A perspective view of another illustrative embodiment of a paperboard pallet 50 is shown in FIG. 7. This embodiment includes top deck boards 10 and 12 sitting flush on stringers 52, 54, and 56 having similar spaces and openings like that previously discussed. This embodiment also has a bottom sheet 58 that spans the stringers 52, 54, and 56 to provide the bottom surface of pallet 50. In this embodiment, however, forklift holes 60 and 62 are disposed in stringers 52, 56, and 58, rather than being a cutout on the bottom of the stringers, as shown with the stringers in FIGS. 1 and 4.

Figure 8:
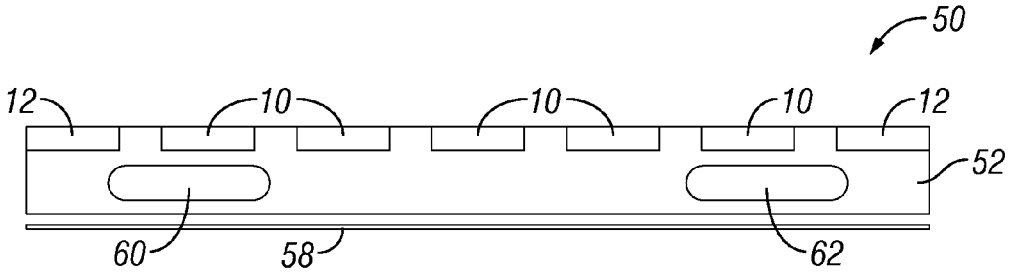
FIG. 8 is a side view of the paperboard pallet of FIG. 7.

A side view of pallet 50 is shown in FIG. 8. This view demonstrates how forklift holes 60 and 62, being disposed within stringer 52, are in contrast to the prior embodiments. Despite this change, pallet 50, and particularly stringer 52 (along with stringers 54 and 56) still accommodates deck boards 12 and 10 along with bottom sheet 58.

Figure 9:
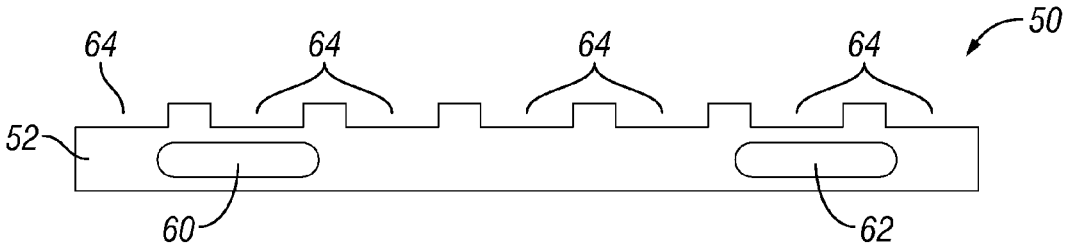
FIG. 9 is a side view of a stringer portion of the paperboard pallet of FIG. 7.

A side view of stringer 52 is shown in FIG. 9. This view demonstrates how the silhouette of stringer 52, as well as stringers 54 and 56, accommodates both notches 64, as well as forklift holes 60 and 62.

Figure 10:
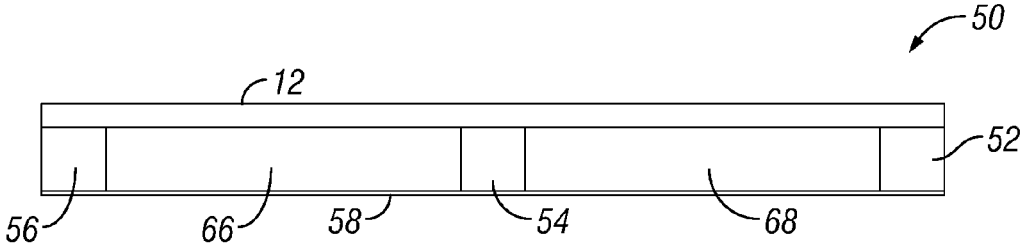
FIG. 10 is a front view of the paperboard pallet of FIG. 7.

A front view of pallet 50 is shown in FIG. 10. This view helps demonstrate how stringers 52, 54, and 56 in combination with deck boards, such as deck boards 10 and 12 and bottom sheet 58, create a pallet that is familiar in its configuration, is lightweight, and durable while not being made of wood. This view also shows spaces 66 and 68 that accommodate forklift blades, as discussed in other embodiments such as spaces 20 and 22 of pallet 2. It is further appreciated that the deck boards may be made from a composite of many strips of corrugated cardboard laminated together with adhesives. Also illustratively, paper, such as craft paper, may be wrapped around the deck boards.

Figure 11:
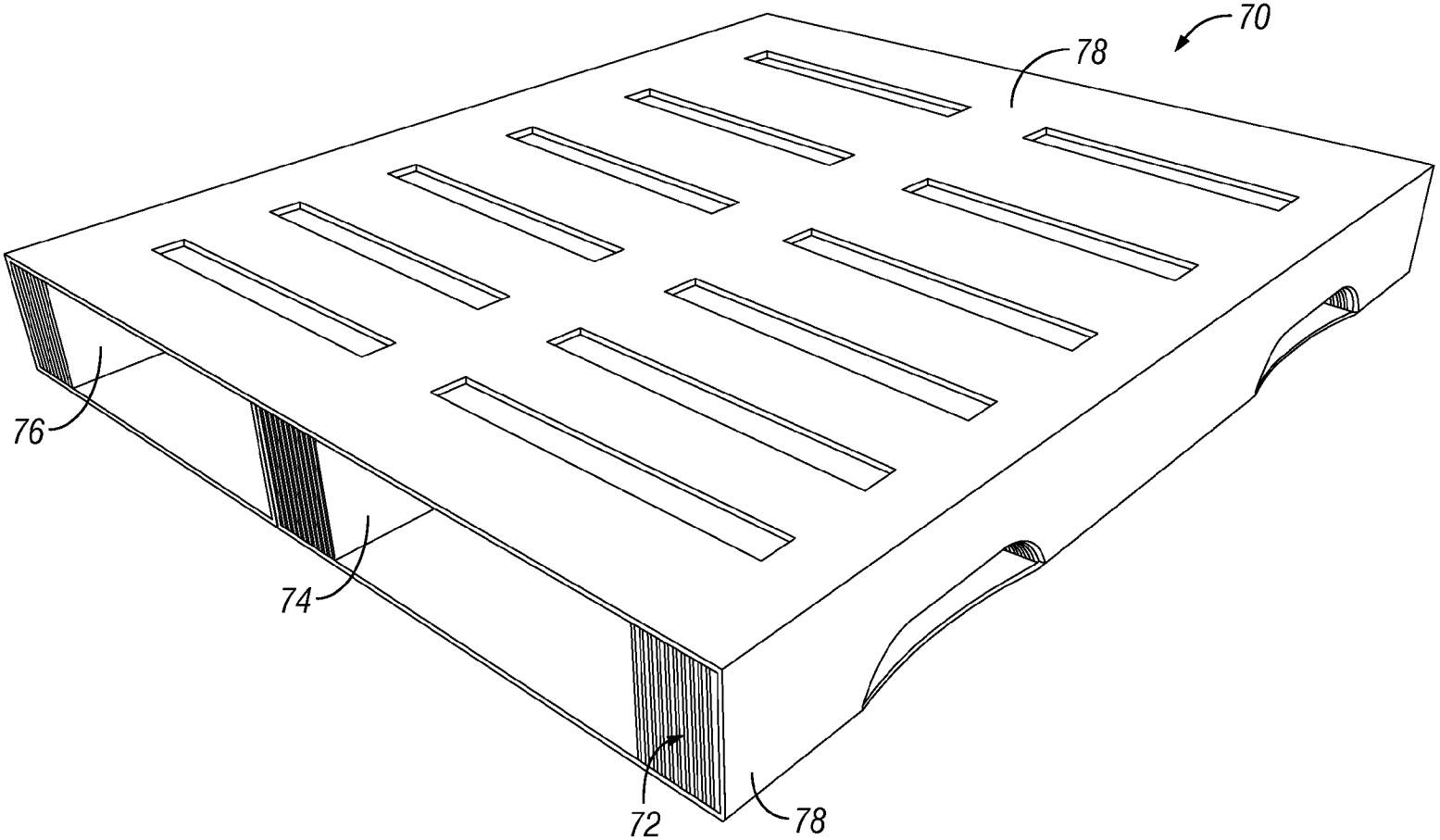
FIG. 11 is a perspective view of another illustrative embodiment of a paperboard pallet.

A perspective view of another illustrative embodiment of paperboard panel 70 is shown in FIG. 11. This embodiment includes stringers 72, 74, and 76 that are spaced apart from each other similar to prior embodiments, but are now wrapped in a folder-style corrugated sheet 78 that forms both the top deck and bottom of pallet 70.

Figure 12:
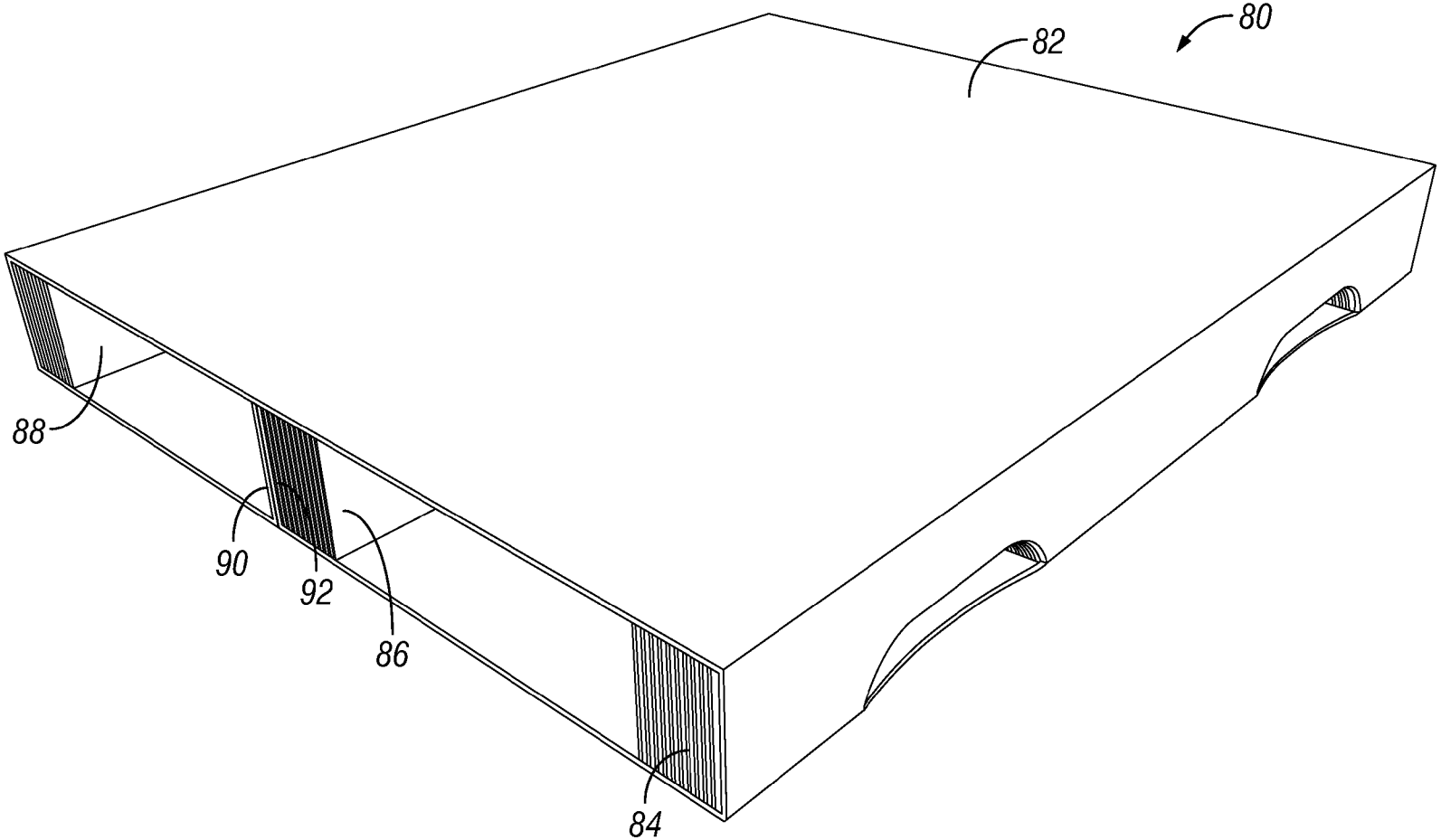
FIG. 12 is a perspective view of another illustrative embodiment of a paperboard pallet.

A perspective view of another illustrative embodiment of a paperboard pallet 80 is shown in FIG. 12. Pallet 80 differs from pallet 70 in that the wrapped sheet 82 is used instead of wrapped sheet 78. As shown in this embodiment, wrapped sheet 82 is folded around stringers 84, 86, and 88 and does not include any openings on the top side surface. This provides a smooth continuous surface area for applications having such a need.

Figure 13:
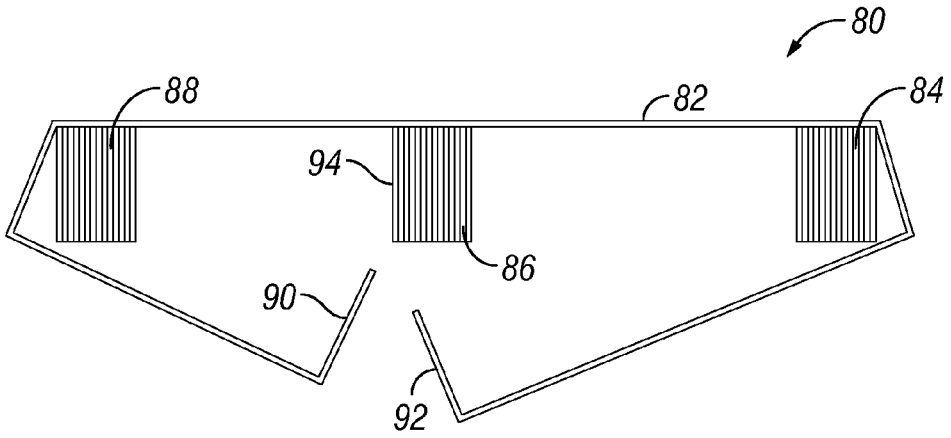
FIG. 13 is a front partially disassembled view of the paperboard pallets of either FIG. 11 or 12.
Figure 14:
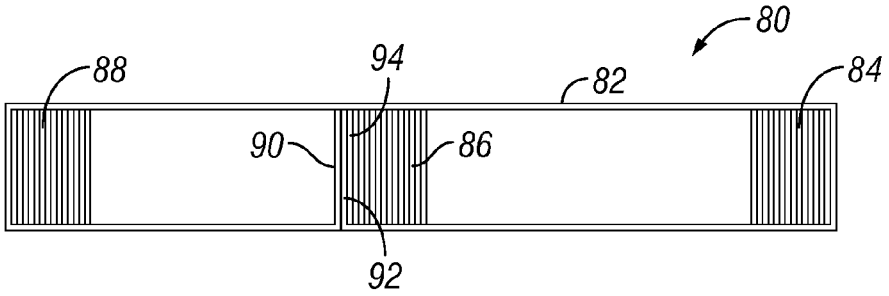
FIG. 14 is a front view of the pallet of either FIG. 11 or 12.
Figure 15:
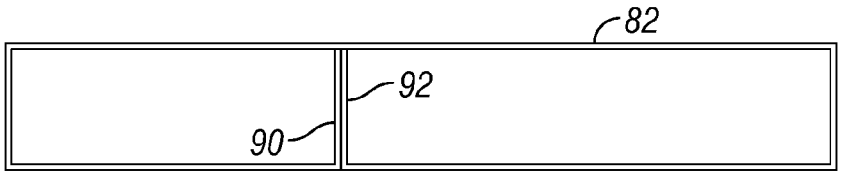
FIG. 15 is an isolated view of a folded sheet that surrounds the paperboard pallet of either FIG. 11 or 12.

A front view of pallet 80 (like pallet 70) demonstrating how wrapped sheet 82 folds around stringers 84, 86, and 88, is shown in FIG. 13. In this embodiment, wrapped sheet 82 folds around to the underside of pallet 80 and includes end portions 90 and 92 which fold upward and adjacent one side of center stringer 86. In the embodiment shown, wrapped sheet 82 folds around the parallel spaced apart stringers 84, 86, and 88. Ends 90 and 92 fold up and are glued against side 94 of stringer 86, as also shown in the end view of FIG. 14. It is appreciated that in this configuration wrapped sheet 82 creates an offset positioning, as demonstrated by the front view of folded wrapped sheet 82 in FIG. 15.

Figure 16:
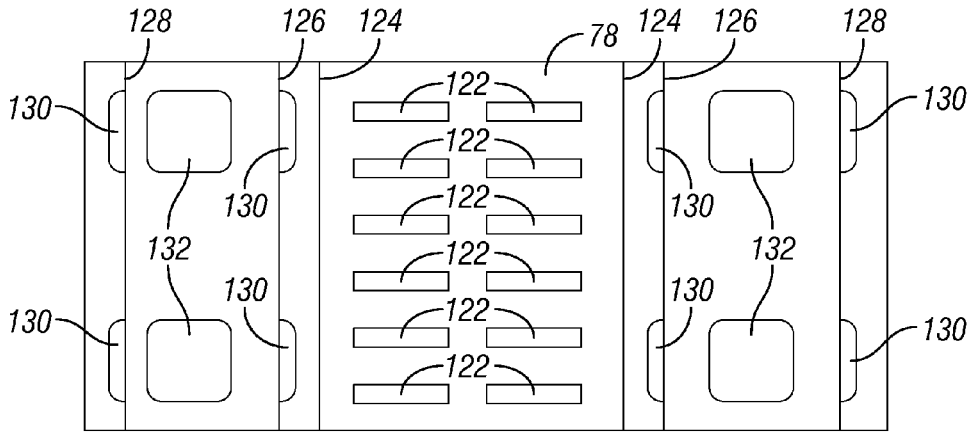
FIG. 16 is a top view of the paperboard sheet of FIG. 11 in an unfolded configuration.
Figure 17:
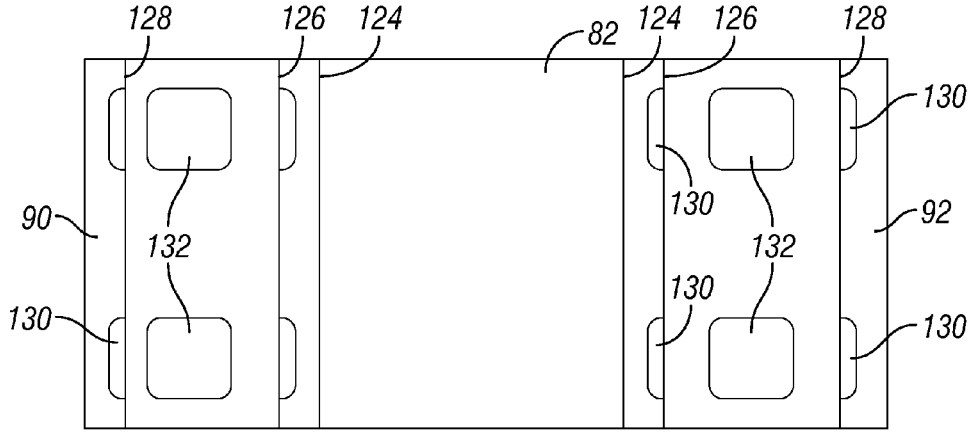
FIG. 17 is a top view of the paperboard sheet of FIG. 12 in unfolded configuration.

Top views of cardboard sheets 78 and 82 in unfolded configurations are shown in FIGS. 16 and 17, respectively. As shown in FIG. 16, sheet 78 includes cut openings 122. Fold lines 124, 126, and 128 may be either scored or otherwise defined as the location where sheet 78 is folded to wrap around the stringers. Also, cut into sheet 78 are forklift openings 130. In the illustrative embodiment, underside openings 132 are cut in sheet 78 (and 82) to reduce material and gain access to the interior of the pallet. In similar fashion, sheet 82 includes score lines 124, 126, and 128 on each side, so sheet 82 may be wrapped around the stringers. In this embodiment, however, there are no cut openings like openings 122 in sheet 78. Instead, the top side of sheet 82 is a continuous surface. There are forklift openings 130 cut as shown, and end portions 90 and 92 are formed by score lines 128 also shown. It is appreciated that the cutouts may be useful even though they might reduce some strength. In certain instances, fire codes require holes in the pallets so water may filter through the pallets from top to bottom. In addition, the cutouts may reduce slippage on the surface. Alternatively, the deck surface may receive an anti-slick agent to reduce slippage. Further, the single sheet may be a 500# double-wall folded sheet of corrugated cardboard.

Figure 18:
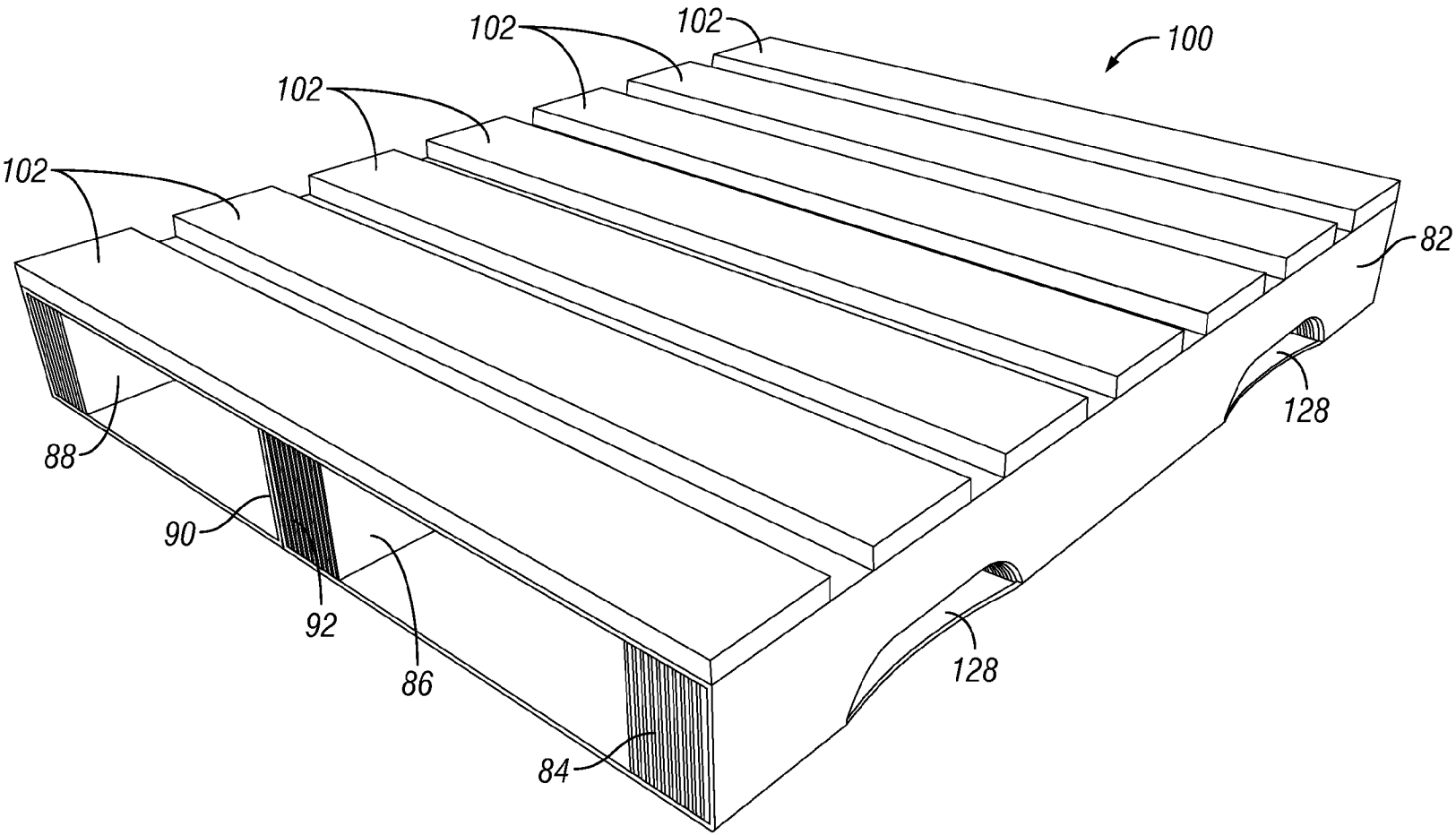
FIG. 18 is a perspective view of another illustrative embodiment of a paperboard pallet.

A perspective view of another illustrative embodiment of a paperboard pallet 100 is shown in FIG. 18. Paperboard pallet 100 is similar to pallet 80 from FIG. 12, but with the addition of deck boards 102 placed on the top. This embodiment includes stringers 84, 86, and 88, like the prior embodiment.

Figure 19:
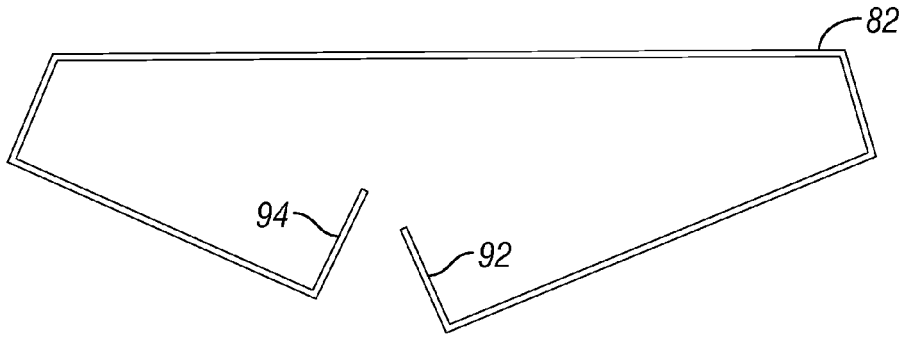
FIG. 19 is an isolated front view of a folded sheet for use on the paperboard pallets of either FIG. 11, 12, or 18.

A front view of a partially folded wrapped sheet 82 (or wrapped sheet 78) is shown in FIG. 19. This view demonstrates how wrapped sheet 82 is folded to fit around the pallet forming an outer skin.

A top view of pallet 100 with deck boards 102 attached on top is shown in FIG. 18. It is appreciated that the horizontal corrugation provided by folded sheet 82, for example, may improve stringer strength. The stringers may also have improved strength by the addition of the corrugated deck boards 102 attached as shown. Such deck boards may also be attached to the underside (not shown) in similar configuration to that shown in FIG. 20.

Figure 20:
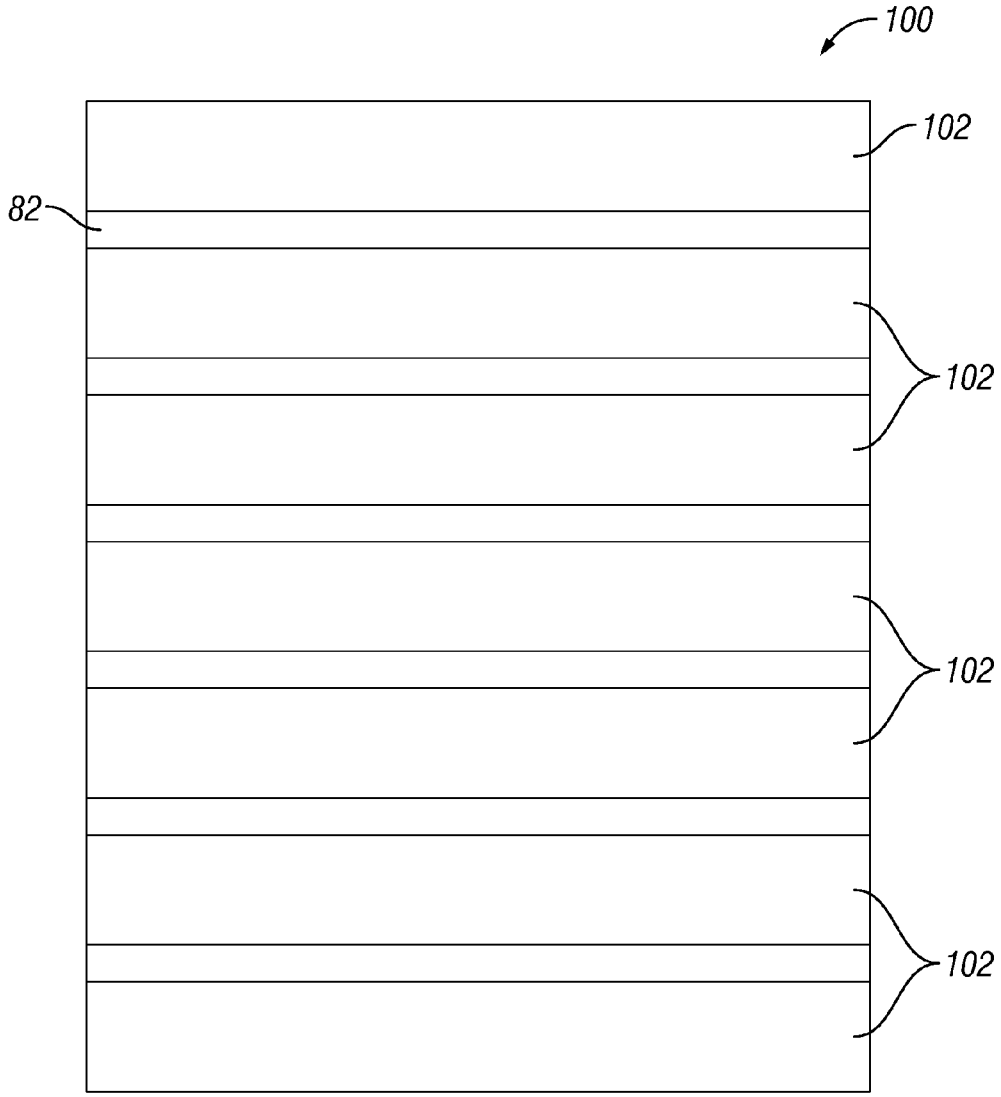
FIG. 20 is a top view of the paperboard pallet of FIG. 18.
Figure 21:
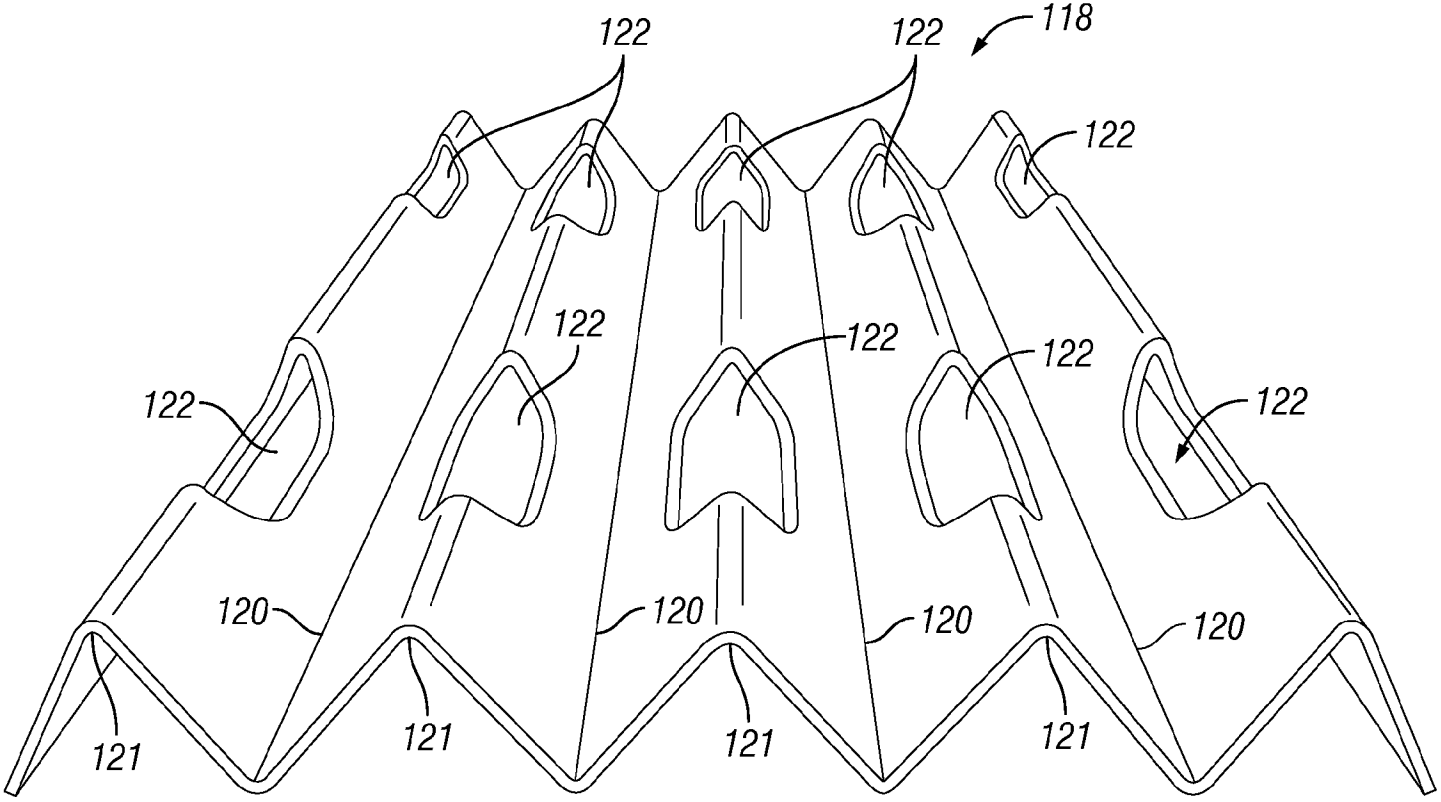
FIG. 21 is a perspective view of an illustrative embodiment of an unassembled stringer composite.

A perspective view of an unassembled stringer 118 is shown in FIG. 20. In this illustrative embodiment, the aforementioned stringers are a composite of corrugated cardboard sheets, sandwiched together, and glued to form a high strength, low weight beam. Unassembled stringer 118 shows how in not all cases the sheets of cardboard need to be completely separate. In this case, score lines 120 may be made at regular intervals and the sheet cut into the desired stringer shape. In an accordion-like fashion, the cardboard may be folded into the stringer. The sheets are then glued together to form the final stringer board. Also shown are cutouts 122 that form the forklift holes in the stringers, as previously discussed in the prior embodiments.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A paperboard pallet comprising:

first and second stringers positioned substantially parallel to each other;

wherein each of the first and second stringers is made of a plurality of bonded sheets of cardboard;

wherein a space is formed between the first and second stringers;

wherein each of the first and second stringers has a top side, an underside, and a first end, wherein the underside is located opposite the top side;

at least a first deck board attached to the first and second stringers and positioned substantially perpendicular to the first and second stringers;

wherein both the first and second stringers include a notch on their top sides;

wherein each notch on the top side of the first and second stringer is sized to receive the first deck board, and is located so a first side of the first deck board in each notch in the top side of the first and second stringers is located substantially flush with the first end of the first and second stringers;

wherein both the first and second stringers include a notch on their undersides;

a second deck board;

wherein each notch on the underside of the first and second stringer is sized to receive the second deck board, and is located so a first side of the second deck board in each notch of the underside of the first and second stringers is located substantially flush with the first end of the first and second stringers;

wherein the first and second stringers include first and second openings each sized to receive a forklift fork; and a cardboard sheet located on the underside of the first and second stringers and defines a portion of the first and second openings sized to receive the forklift.

2. The paperboard pallet of claim 1, wherein the cardboard is corrugated cardboard.

3. The paperboard pallet of claim 1, further comprising a third stringer located in the space formed between the first and second stringers, which creates a second space in addition to the first space.

4. The paperboard pallet of claim 1, wherein both of the first and second stringers have a second end located opposite the first end.

5. The paperboard pallet of claim 1, further comprising a second deck board, wherein the second deck board is positioned substantially parallel to and spaced apart from the first deck board.

6. The paperboard pallet of claim 5, further comprising a second notch on the top side of each of the first and second stringers, wherein each second notch on the top side of the first and second stringers is sized to receive the second deck board.

7. The paperboard pallet of claim 6, wherein the second deck board is fitted in the second notch on the top side of each of the first and second stringers, wherein the deck board is substantially flush with the topside of the first and second stringers.

* * * * *